United States Patent [19]

Edwards

[11] Patent Number: 5,025,203

[45] Date of Patent: Jun. 18, 1991

[54] CIRCUIT FOR USE WITH A VOLTAGE REGULATOR

[75] Inventor: Arthur J. Edwards, Hoffmann Estates, Ill.

[73] Assignee: Motorola, Inc., Schaumburg, Ill.

[21] Appl. No.: 415,674

[22] Filed: Oct. 2, 1989

[51] Int. Cl.[5] ..... G05F 1/44

[52] U.S. Cl. ..... 323/268; 323/269; 361/18

[58] Field of Search ..... 323/268, 269, 271, 272, 323/273, 276, 282, 349, 350, 351; 363/55, 56, 65; 361/18; 307/9.1, 10.1, 10.3, 10.6, 10.7

[56] References Cited

FOREIGN PATENT DOCUMENTS 0847301 7/1981 U.S.S.R. ..... 323/269

*Primary Examiner*—Steven L. Stephan
*Assistant Examiner*—Emanuel Todd Voeltz

[57] ABSTRACT

A circuit (2) for use with an automotive voltage regulator (16), having: an input node (4) for receiving an input voltage ($V_{BAT}$); an output node (12) for producing a regulated output voltage ($V_{REG}$); a control node (18) for receiving a control signal from the voltage regulator; a first transistor (10) having its emitter connected via a protection diode (6) to the input node, its collector connected to the output node, and its base connected to the control node; an electrolytic input capacitor (8) connected between the first transistor emitter and ground; an electrolytic output capacitor (14) connected between the output node and ground; and a second transistor (32) having its emitter connected to the input node, its collector coupled to the output node, and its base for coupling to the voltage regulator. The second transistor allows the circuit to provide regulation at a lower input voltage, while retaining the protection diode. The circuit may be fabricated in integrated circuit form, possibly including the voltage regulator.

10 Claims, 1 Drawing Sheet

CIRCUIT FOR USE WITH A VOLTAGE REGULATOR

BACKGROUND OF THE INVENTION

This invention relates to a circuit for use with a voltage regulator. Such circuits find use with, for example, voltage regulators for use in automotive applications, e.g. for regulating the automotive battery voltage applied to an electronic module such as an ignition or anti-lock braking control module.

In a typical known circuit for use with a voltage regulator in automotive applications the circuit comprises a bipolar pnp transistor having its emitter connected at the circuit's input to battery voltage via a diode, and its collector connected to provide a regulated voltage at the circuit's output. The transistor's collector is connected to provide feedback to a regulator which produces a control signal applied to the transistor's base. Input and output charge storage capacitors are connected between earth and, respectively, the transistor's emitter and collector.

The diode protects the transistor and the input capacitor from being subjected to a negative voltage which may be presented at the circuit's input. The input capacitor (which, since it is protected by the diode, can be electrolytic) is charged to a voltage close to the battery voltage, and so prevents brief negative voltage transients at the circuit input from propagating through to the output capacitor (which can also be electrolytic). However, the presence of the diode introduces an additional voltage drop between the circuit's input and output which the battery voltage must exceed for satisfactory operation. In a typical such circuit the battery voltage must exceed the regulated voltage by at least 0.9 V for satisfactory normal operation.

If the protection diode were removed, operation would be provided at a lower battery voltage. However, in this case the input capacitor could be exposed to negative voltage presented at the circuit input, and so would have to be non-polar, in which case it would typically be of much smaller value than the output capacitor (which can still be electrolytic) and so could not adequately buffer the output capacitor against negative transients at the circuit input.

SUMMARY OF THE INVENTION

It is an object of the present invention to provide an improved circuit for use with a voltage regulator wherein the above disadvantages may be overcome or at least alleviated.

In accordance with present invention there is provided a circuit for use with a voltage regulator, comprising:

a first node for receiving an input voltage;

a second node for producing a regulated output voltage and for coupling to the voltage regulator;

a third node for connection to the voltage regulator to receive a control signal therefrom;

first control means having a voltage input coupled to the first node, a voltage output coupled to the second node, and a control input coupled to the third node the first control means controlling the flow of current therethrough between the first node and the second node;

diode means coupled between the first node and the first control means voltage input; the improvement comprising second control means having a voltage input connected to the first node, a voltage output coupled to the second node, and a control input coupled to the third node, the second control means controlling the flow of current therethrough between the first node and the second node.

The provision of the second control means allows the circuit to provide regulation at a lower input voltage, while the diode means protects the first control means and allows an electrolytic input capacitor to be connected to the first control means voltage input.

BRIEF DESCRIPTION OF THE DRAWINGS

One circuit for use with a voltage regulator in accordance with the present invention will now be described with reference to the accompanying drawings, in which.

DESCRIPTION OF THE PREFERRED EMBODIMENT

Figure 1:
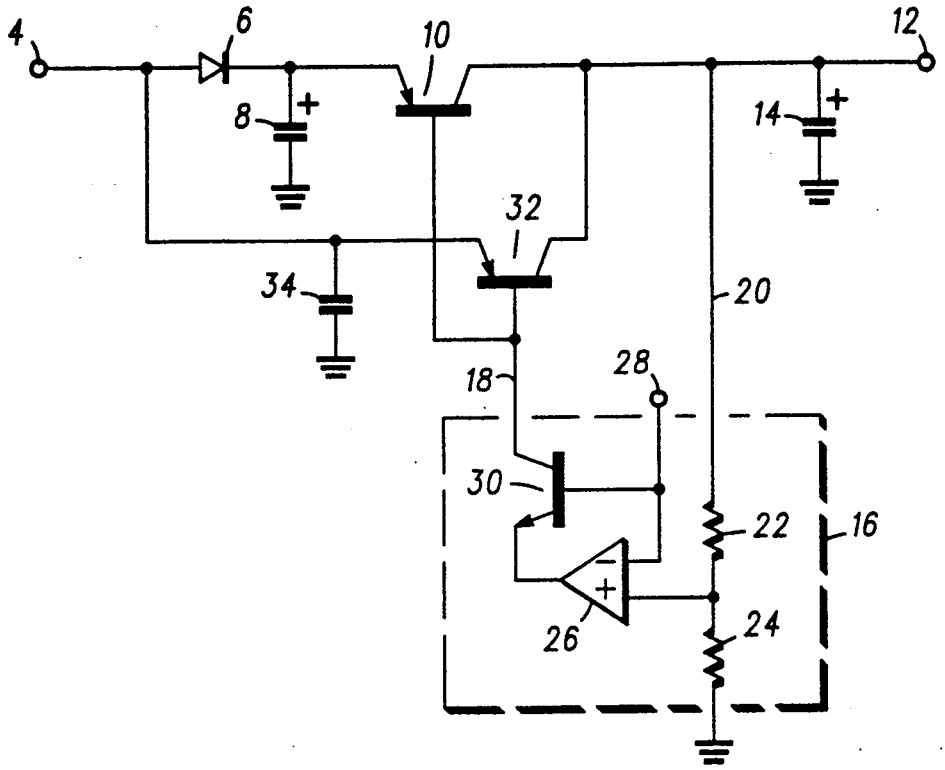
FIG. 1 shows a circuit diagram of an automotive voltage regulator circuit.

Referring now to FIG. 1, an automotive voltage regulator circuit 2 for supplying a regulated voltage $V_{REG}$ to an electronic ignition control module (not shown) has an input node 4 for connection to a voltage $V_{BAT}$ provided by an automobile battery (not shown). A diode 6 has its anode connected to the input node 4. An electrolytic capacitor 8 has its positive polarity electrode (+) connected to the cathode of diode 6, and has its other electrode connected to ground.

A bipolar pnp transistor 10 has its emitter also connected to the cathode of diode 6, and has its collector connected to an output node 12. An electrolytic capacitor 14 has its positive polarity electrode (+) connected to the output node 12, and has its other electrode connected to ground. The transistor 10 has its base connected to a voltage regulator 16 at its control output 18. The voltage regulator 16 also has a sense input 20 which is connected to the output node 12.

The voltage regulator 16 comprises resistors 22 and 24 connected in series between the sense input 20 and ground. The common point of the resistors 22, 24 is connected to a differential amplifier 26 at its non-inverting input. A node 28 for receiving a reference voltage $V_{REF}$ is connected to the differential amplifier 26 at its inverting input. A bipolar npn transistor 30 has its base connected to the voltage reference node 28, its emitter connected to the output of the differential amplifier 26, and its collector connected to the control output 18. Such a voltage regulator is well known in the art, and needs no further detailed explanation.

A further bipolar pnp transistor 32 has its emitter connected to the input node 4, and has its collector connected to an output node 12. The transistor 32 has its base connected to the control output 18 of the voltage regulator 16. The transistor 32 has a high emitter-base breakdown voltage $V_{EBO}$ so that it can withstand negative voltage transients at the input node 4. A non-polar capacitor 34 has one electrode connected to the input node 4, and has another electrode connected to ground.

In use of the voltage regulator circuit of FIG. 1, the bases of the two transistors 10 and 32 are supplied with the same control signal from the voltage regulator 16. Under normal conditions, with the input battery voltage $V_{BAT}$ exceeding the required regulated output voltage $V_{REG}$ by 1 V or more, the transistor 32 conducts and supplies current from the input node 4 to the output node 12. If the input voltage $V_{BAT}$ should increase, the initial increase increase in the output voltage $V_{REG}$, the initial increase in $V_{REG}$ is sensed by the voltage regulator 16 which accordingly reduces the signals applied to the bases of the transistors so as to reduce the current conducted by the transistors and so contain the output voltage $V_{REG}$ to substantially the desired level. In this mode the circuit of FIG. 1 operates in essentially the same way as the known prior art circuit discussed above.

The transistor 32 normally conducts, rather than the transistor 10, because under normal conditions the transistor 32 has a higher emitter voltage than the transistor 10. This allows the transistor 10 to be smaller and also allows the capacitor 8 to charge better.

If the input voltage $V_{BAT}$ falls to a level slightly less than 1 V above the required regulated output voltage $V_{REG}$, the transistor 32 continues to conduct, since there is no diode-induced voltage drop between its emitter and the input node 4. In this mode the transistor 32 alone continues to supply the current to the output node 12. This conduction mode may prove useful when the battery voltage is low due to high loading under adverse conditions, e.g. when "cold cranking" (i.e. turning the automobile engine at low temperature).

If a sudden negative transient or drop-out in the battery voltage occurs which causes the input voltage $V_{BAT}$ to fall from its normal voltage to a level less than the required regulated output voltage $V_{REG}$, the transistor 32 ceases to conduct, and the transistor 10 supplies energy to the output node 12 from the input capacitor 8, which will have been charged to a level approaching $V_{BAT}$ prior to the arrival of the transient or drop-out. The capacitor 20 has a small value (e.g. $\leqq 1\mu F$) and does not produce sufficient energy storage; it is provided to filter out fast transients.

It will be appreciated that by providing two parallel current paths (6 and 10; 32) between the input and output controlled from the same voltage regulator 16, and by providing the diode 6 in only one of these paths, the circuit of FIG. 1 offers the following advantages:

(i) it allows normal satisfactory operation at a lower battery voltage $V_{BAT}$ than the prior art (when the transistor 32 conducts but the transistor 10 does not conduct), and (ii) the diode 6 protects the transistor 10 and the capacitor 8 from being subjected to a negative voltage which may be presented at the input node 4, thus allowing the capacitor 8 to be electrolytic and so typically a sufficiently high value to adequately buffer the output capacitor 14 against negative transients at the input node 4. It is well known that, for a given size, the capacitance of an electrolytic capacitor may exceed that of a non-polar capacitor, typically by a factor of 100.

Figure 2:
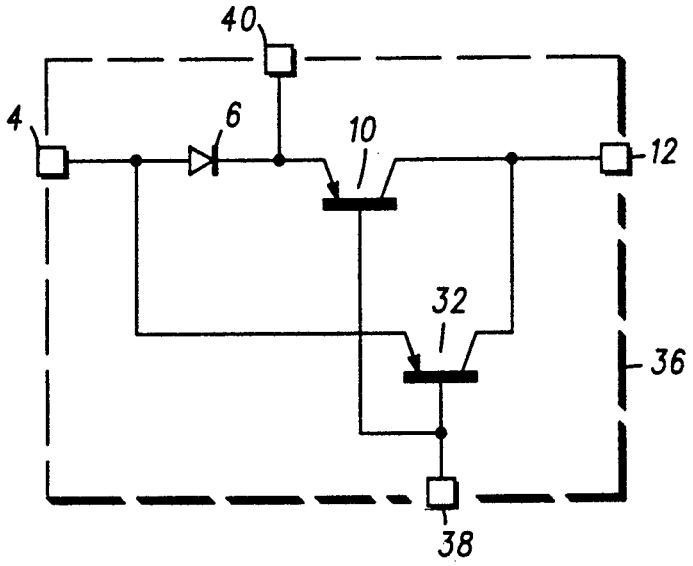
FIG. 2 shows a circuit diagram of a part of the circuit of FIG. 1 which may be fabricated as an integrated circuit.

Although the circuit of FIG. 1 uses a larger number of components than the prior art circuit discussed above, and so if made from discrete components will be more expensive and larger, the part 36 of the circuit (shown separately in FIG. 2) formed by the input node 4, the diode 6, the transistor 10, the transistor 32 and the output node 12 may be fabricated as a single integrated circuit (IC) component 36. Such an IC can be made to fit within a 5-lead TO220 ("pentawatt") package. The IC 36 is provided with a node 38 for connection to the control output 18 of the voltage regulator 16, and is provided with a node 40 for connection to the capacitor 8. The capacitors 34 and 14 may be connected respectively to the input and output nodes of the IC 36. This will leave only the capacitors 8, 14 and 34 and the voltage regulator 16 to be provided as external components. As a further step in integration beyond this, the voltage regulator 16 may be integrated into the same IC.

Whilst it may not be immediately obvious to do so, it is normally possible to connect the bases of the pnp transistors 10 and 32 together, without malfunction. The transistor which conducts at any one time will be the one with the higher emitter voltage, usually the transistor 32. Even in the case of a negative voltage transient occurring at the input node 4, the transistor 10 is correctly turned on, since the capacitor 8 will have a higher voltage than the input node 4. In this case the transistor 32 will be "off", since its base will be above or near to its collector voltage, suppressing reverse conduction.

It will be appreciated that if the transistor 32 is designed with a very low reverse hFE parameter, the possibility of transistor 32 sourcing current from the output node 12 to the input node 4 if the battery voltage $V_{BAT}$ should drop below the required regulated output voltage $V_{REG}$ is substantially eliminated and the bases of the two transistors can be connected together. This will normally be the case.

It will be appreciated that various modifications or alternatives to the above described embodiments will be apparent to the man skilled in the art without departing from the inventive concept.

I claim:

1. A circuit for use with a voltage regulator, comprising:

a first node for receiving an input voltage;

a second node for producing a regulated output voltage and for coupling to the voltage regulator;

a third node for connection to the voltage regulator to receive a control signal therefrom;

first control means having a voltage input coupled to the first node, a voltage output coupled to the second node, and a control input coupled to the third node, the first control means controlling the flow of current therethrough between the first node and the second node;

diode means coupled between the first node and the first control means voltage input; the improvement comprising second control means having a voltage input connected to the first node, a voltage output coupled to the second node, and a control input coupled to the third node, the second control means controlling the flow of current therethrough between the first node and the second node.

2. A circuit according to claim 1 further comprising an input capacitor coupled between the first control means voltage input and a reference potential.

3. A circuit according to claim 2 wherein the input capacitor is electrolytic.

4. A circuit according to claim 1 further comprising an output capacitor coupled between the first control means voltage output and a reference potential.

5. A circuit according to claim 4 wherein the output capacitor is electrolytic.

6. A circuit according to claim 1 further comprising a transient filter capacitor coupled between the first node and a reference potential.

7. A circuit according to claim 1 wherein the first and second control means comprise bipolar pnp transistors.

8. A circuit according to claim 1 further comprising the voltage regulator.

9. An integrated circuit for use with a voltage regulator, comprising:

a first node for receiving an external input voltage;

a second node for producing a regulated output voltage and for coupling to the voltage regulator;

a third node for connection to the voltage regulator to receive a control signal therefrom;

first control means having a voltage input coupled to the first node, a voltage output coupled to the second node, and a control input coupled to the third node, the first control means controlling the flow of current therethrough between the first node and the second node;

diode means coupled between the first node and the first control means voltage input; and second control means having a voltage input connected to the first node, a voltage output coupled to the second node, and a control input coupled to the third node, the second control means controlling the flow of current therethrough between the first node and the second node.

10. A circuit for use with a voltage regulator, comprising:

a first node for receiving an input voltage;

a second node for producing a regulated output voltage and for coupling to the voltage regulator;

a third node for connection to the voltage regulator to receive a control signal therefrom;

a first bipolar pnp transistor having an emitter coupled to the first node, a collector coupled to the second node, and a base coupled to the third node;

diode means coupled between the first node and the first transistor emitter;

an electrolytic input capacitor having a first terminal coupled to the first transistor emitter and having a second terminal for coupling to a reference potential;

an electrolytic output capacitor having a first terminal coupled to the second node and having a second terminal for coupling to a reference potential; the improvement comprising a second bipolar pnp transistor having an emitter connected to the first node, a collector coupled to the second node, and a base coupled to the third node.

* * * * *